US006315026B1

(12) United States Patent
Ross

(10) Patent No.: US 6,315,026 B1
(45) Date of Patent: Nov. 13, 2001

(54) CORNICE BOX

(76) Inventor: Stephen C. Ross, 18712 Rancho Circle La., Yorba Linda, CA (US) 92886

( * ) Notice: Subject to any disclaimer, the term of this patent is extended or adjusted under 35 U.S.C. 154(b) by 0 days.

(21) Appl. No.: 09/755,998

(22) Filed: Jan. 8, 2001

(51) Int. Cl.[7] ..... E04F 10/00
(52) U.S. Cl. ..... 160/38
(58) Field of Search ..... 160/38, 39, 19, 160/330

(56) References Cited

U.S. PATENT DOCUMENTS 1,386,715 * 8/1921 Lewin ..... 160/38
1,929,140 * 10/1933 Gabel ..... 160/38
4,246,951 * 1/1981 Givens ..... 160/39
5,042,549 * 8/1991 Roberts ..... 160/39
5,944,084 * 8/1999 Cadorette ..... 160/38

* cited by examiner

*Primary Examiner*—David M. Purol
(74) *Attorney, Agent, or Firm*—Goldstein Law Offices P.C.

(57) ABSTRACT

A cornice box, for mounting on a wall, comprising outer panels made of foam and having an upper surface, and mounting strip channels adjacent the upper surface. The cornice box has mounting strips extending in the mounting strip channels which are partially exposed at the upper surface. A mounting board made of a strong, rigid material is attached to the outer panels by screwing through the mounting board into the mounting strips. The mounting board is attached to the wall using brackets.

9 Claims, 4 Drawing Sheets

CORNICE BOX

BACKGROUND OF THE INVENTION

The invention relates to a cornice box. More particularly, the invention relates to an ornamental structure that may be mounted above a window frame, concealing curtain rods, vertical blind housings, and the like.

In the past, interior ornamental structures were made of heavy materials such as wood or metal, or sculpted of plaster. The increasing cost of traditional building materials has prompted the construction industry to seek alternative construction materials.

In recent years, foam has become a viable alternative for many building applications. Although foam has become increasingly popular as a building material, other attempts to use it for interior fixtures have lacked strength and durability.

While these units may be suitable for the particular purpose employed, or for general use, they would not be as suitable for the purposes of the present invention as disclosed hereafter.

SUMMARY OF THE INVENTION

It is an object of the invention to produce a cornice box suitable for mounting above a window frame.

It is another object of the invention to provide a cornice box which effectively conceals window treatment housings and curtain rods, while matching the decor of the room in which it is mounted.

It is a further object of the invention that the majority of the cornice box may be constructed of lightweight foam, but which is constructed to derive its strength from stronger materials that are used for a few key components of the cornice box.

It is a still further object of the invention that the cornice box is mounted using a rigid mounting board which extends horizontally. The mounting board provides structural strength and stability to the cornice box, and is attached to the foam components along a broad surface area by means of a mounting strip.

The invention is a cornice box, for mounting on a wall, comprising outer panels made of foam and having an upper surface, and mounting strip channels adjacent the upper surface. The cornice box has mounting strips extending in the mounting strip channels which are partially exposed at the upper surface. A mounting board made of a strong, rigid material is attached to the outer panels by screwing through the mounting board into the mounting strips. The mounting board is attached to the wall using brackets.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
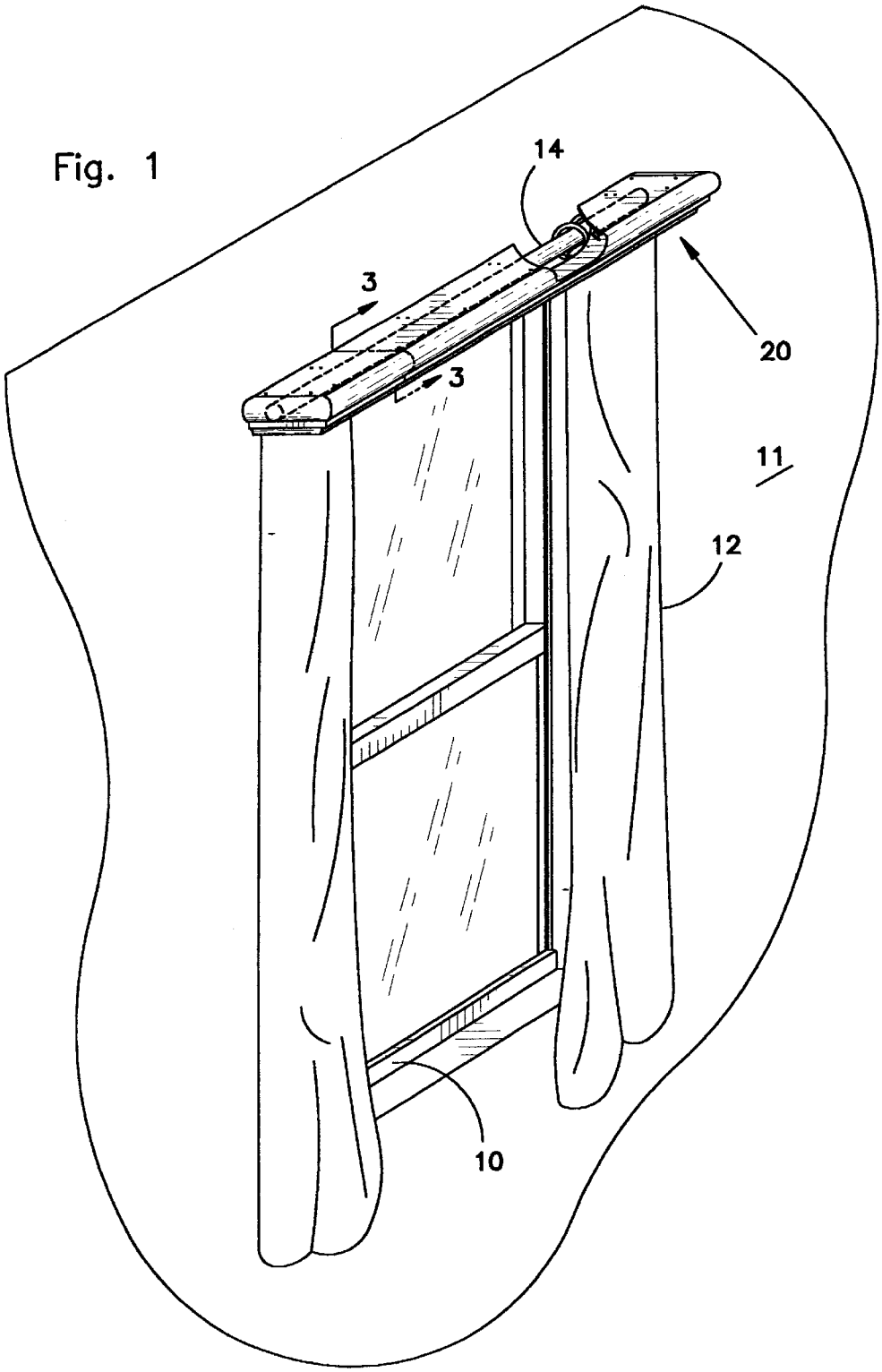
FIG. 1 is a diagrammatic perspective view of the invention, mounted above a window.

FIG. 1 illustrates a window 10, in a wall 11. The window has curtains 12, which are attached to a curtain rod 14 which is mounted immediately above the window 10.

According to the present invention, the curtain rod 14 is concealed within a cornice box 20. The cornice box 20 may be covered with a decorative fabric, or painted to blend in to the decor, and match the curtains 12.

Advantageously, the majority of the cornice box 20 is constructed of foam material. However, it is undesirable to make the entire cornice box 20 out of foam, because a cornice box 20 made entirely out of foam not have the strength required for long range durability. Therefore, referring to FIG. 3, the cornice box comprises outer panels 22 made of foam and a mounting board 23, which is preferably made of a strong, rigid material such as wood or solid plastic.

Figure 3:
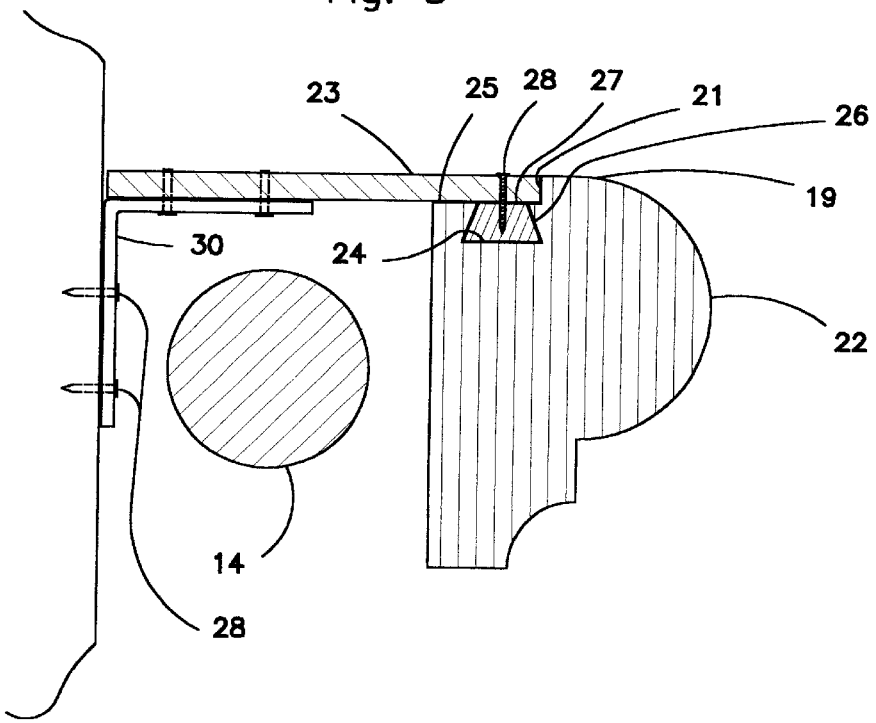
FIG. 3 is a cross sectional view, taken along line 3—3 in FIG. 1.

As illustrated in FIG. 3, the outer panels having a top edge 19, and a mounting strip channel 24 for receiving a mounting strip 26, also normally made of wood. The outer panels 22 have an upper surface 25, the mounting strip channels 24 near the upper surface such that, referring momentarily to FIG. 4A, the mounting strip channel 24 is exposed lengthwise through the upper surface 25. The mounting strips 26 have a top surface 27 which is exposed through the upper surface 25 of the outer panels 22 when the mounting strips 26 are in place in the mounting strip channels 24.

The outer panels 22 have an indenture 21, wherein the upper surface is indented from the top edge 19 for accommodating the mounting board. The indenture is equal in height to the thickness of the mounting board 23.

Once the mounting strip 26 is fully inserted into the mounting strip channel 24, the mounting strip 26 is attached to the mounting board 23 by screws 28. The screws extend downward through the mounting board 23 and into the top surface of the mounting strip 26. Thus, since the mounting board 23 is not screwed directly to the outer panels 22, the load is distributed along the entire mounting strip channel 24. The mounting strip 26 and mounting strip channel 24 have an identical, but irregular shaped cross-section. As illustrated in FIG. 3, a trapezoidal shape is employed, the trapezoid having a base that is opposite the mounting board, and two congruent sides which angle inward and upward toward the upper surface 25 and toward the mounting board 23. This arrangement, provides considerable vertical strength by distributing all vertical forces along the equal legs of the trapezoid.

The mounting board 23 is attached to the wall by means of right angle brackets 30. Advantageously, the brackets 30 are first attached to the wall 11 with screws 28, and then the cornice box 20 is lowered over the brackets 30 until the mounting board 23 rests on the brackets 30. The brackets are then secured to the mounting board 23 by screwing upward through the brackets 30 and into the mounting board 23. thus, the curtain rod 14 is concealed behind the outer panels 22.

Figure 2:
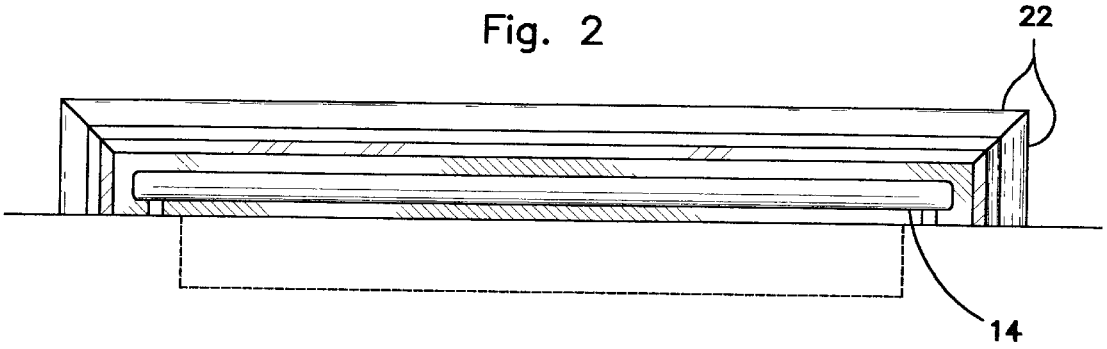
FIG. 2 is a bottom plan view of the invention.

Referring to FIG. 2, advantageously, the arrangement of outer panels 22 provides an open space which ample room for the curtain rod 14, or other window treatments, and allows easy access from below to the mounting board and associated brackets 30 (not shown). Thus, after the mounting board 23 is positioned on the brackets 30, a construction worker has sufficient room to reach the brackets with a screw gun to secure the brackets to the mounting board 23.

Figure 4A:
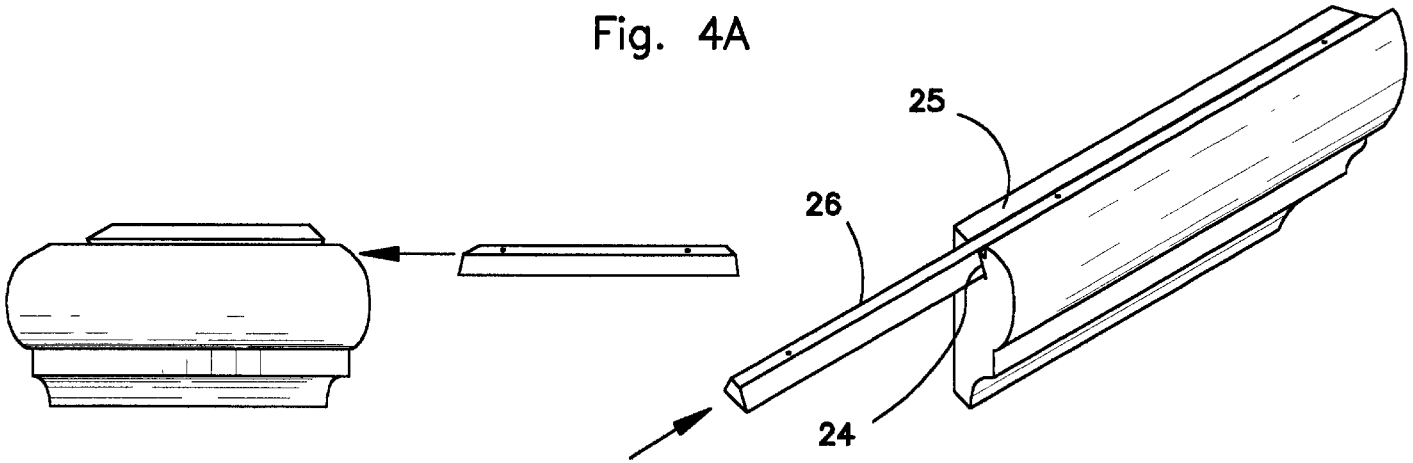
FIG. 4A is a diagrammatic perspective view, illustrating a first step in assembling the invention.
Figure 4B:
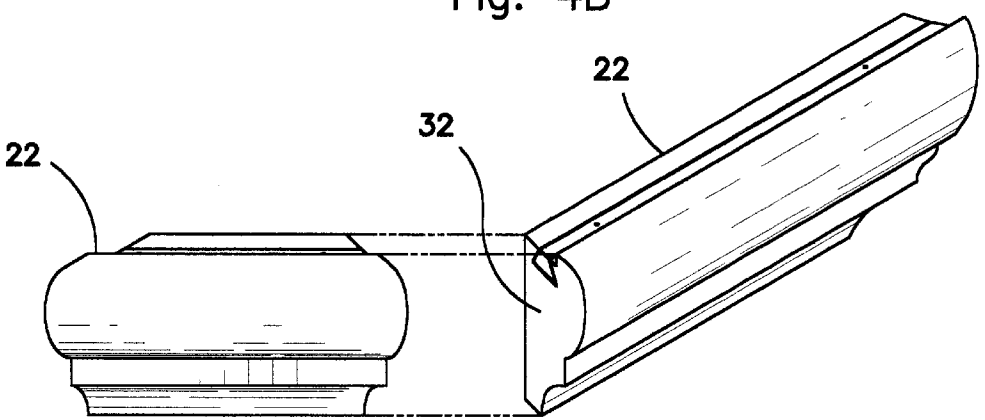
FIG. 4B is a diagrammatic perspective view, illustrating a second step in assembling the invention.
Figure 4C:
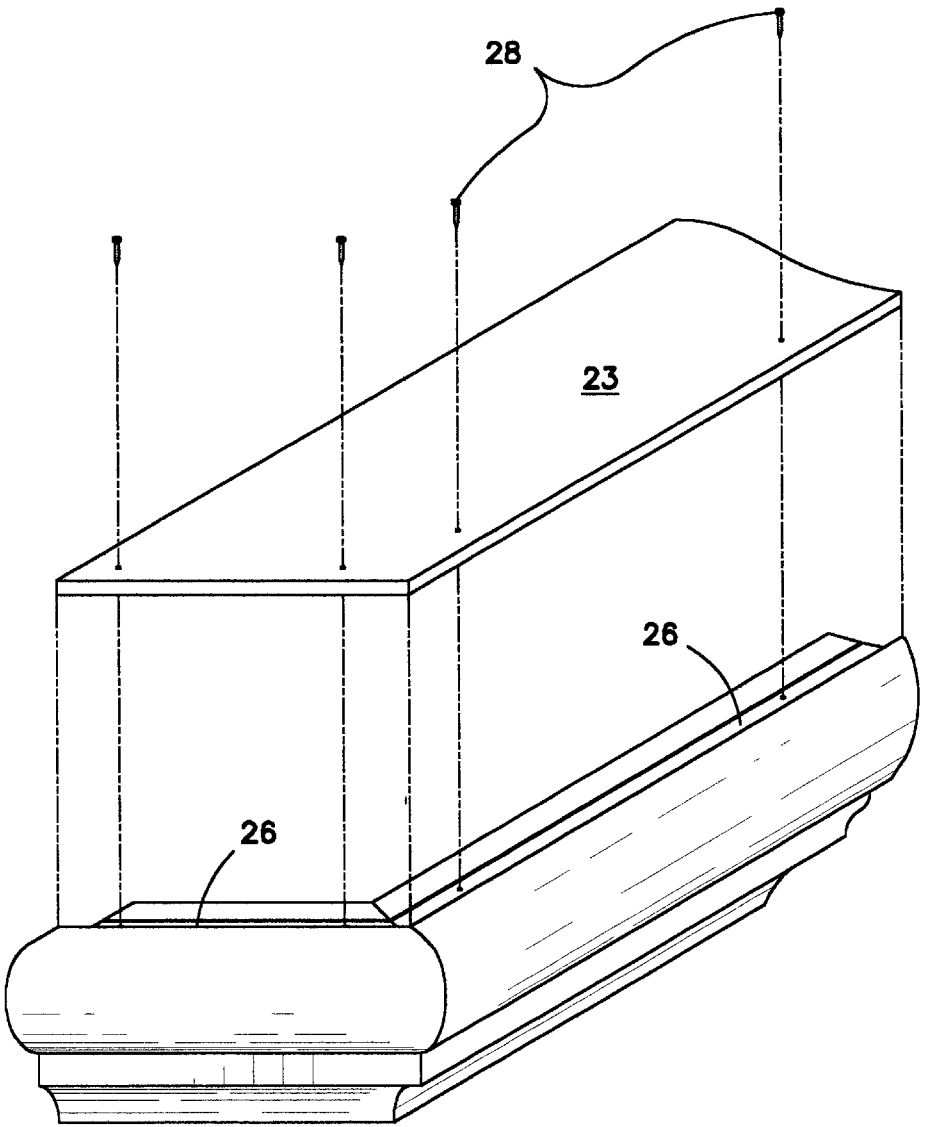
FIG. 4C is a diagrammatic perspective view, illustrating a third step in assembling the invention.

FIGS. 4A–4C illustrate a temporal sequence of constructing the cornice box 20. FIG. 4A illustrates the mounting strip 26 being inserted in the mounting strip channel 24.

FIG. 4B illustrates the outer panels 22 being attached to one another. The outer panels 22 have mitered ends 32, which are cut at a 45 degree angle, so that the outer panels can meet at a 90 degree angle, while the mitered ends of adjacent outer panels 22 rest flush against each with a broad surface area between them in contact.

FIG. 4C illustrates the mounting board 23 being positioned in the indenture 21 of the upper panels. The mounting board 23 is then attached to the outer panels 22 by screwing the mounting board 23 into the mounting strip channel 24 with an attachment means, such as the screws 28 illustrated.

In conclusion, herein is presented a cornice box construction which allows said decorative structure to be constructed mostly of foam, while maintaining the strength needed for secure mounting and long term durability.

What is claimed is:

1. A cornice box, comprising:

outer panels made of foam, the outer panels having an upper surface having mounting strip channels extending horizontally along the outer panels;

a mounting board made of a rigid material;

mounting strips extending in the mounting strip channels, the mounting strips having a mounting strip top surface that is exposed through the mounting strip channels; and a means for fastening the mounting board to the mounting strips to attach the mounting board to the outer panels.

2. The cornice box as recited in claim 1, further comprising mounting brackets, attached to the mounting board, for attaching the cornice box to a wall.

3. The cornice box as recited in claim 2, wherein the mounting brackets are right angle brackets attached beneath the mounting board.

4. The cornice box as recited in claim 3, wherein the mounting board is made of a material selected from wood and solid plastic, the mounting board having a thickness, and wherein the outer panels have an indenture such that the upper surface is indented a distance equal to the thickness of the mounting board.

5. The cornice box as recited in claim 4, wherein the outer panels further comprise mitered ends, which mate to adjacent outer panels.

6. The cornice box as recited in claim 1, wherein the mounting strips are of trapezoidal cross section having a pair of congruent sides, and wherein the mounting strip channels are trapezoidal cross section channels which extend lengthwise along the outer panels.

7. The cornice box as recited in claim 6, wherein the mounting mechanism are screws extending downward through the mounting board and into the mounting strips.

8. The cornice box as recited in claim 6, wherein the congruent sides of the trapezoid are angled inward toward the top surface of the upper panels.

9. The cornice box as recited in claim 8, wherein the mounting mechanism are screws extending downward through the mounting board and into the mounting strips.

* * * * *